US007467650B2

(12) United States Patent
Massey

(10) Patent No.: US 7,467,650 B2
(45) Date of Patent: Dec. 23, 2008

(54) DISPENSER PROTECTOR DEVICE

(75) Inventor: Jennifer Massey, North Hollywood, CA (US)

(73) Assignee: The Hardway, LLC, North Hollywood, CA (US)

( * ) Notice: Subject to any disclaimer, the term of this patent is extended or adjusted under 35 U.S.C. 154(b) by 52 days.

(21) Appl. No.: 10/893,796

(22) Filed: Jul. 17, 2004

(65) Prior Publication Data

US 2006/0011669 A1 Jan. 19, 2006

(51) Int. Cl.
*B65B 1/04* (2006.01)

(52) U.S. Cl. ..... 141/386; 285/8; 239/26; 222/567; 137/603

(58) Field of Classification Search ..... 141/2, 141/18, 383–386; 285/8; 137/603, 801; 4/617; 239/25, 26; 222/567
See application file for complete search history.

(56) References Cited

U.S. PATENT DOCUMENTS

| | | | | | |
|---|---|---|---|---|---|
| 703,874 | A * | 7/1902 | White | 141/301 |
| 981,702 | A * | 1/1911 | Smith | 210/459 |
| 1,050,615 | A * | 1/1913 | Coates | 285/8 |
| 1,105,258 | A * | 7/1914 | Cornelius | 137/378 |
| 1,367,696 | A * | 2/1921 | Grokosky | 239/26 |
| 1,504,623 | A * | 8/1924 | Hulla | 239/26 |
| 1,618,682 | A * | 2/1927 | Snapp | 99/534 |
| 1,681,838 | A * | 8/1928 | Conklin | 285/8 |
| 1,724,131 | A * | 8/1929 | Gavaza | 285/8 |
| 1,893,498 | A * | 1/1933 | Herzog | 134/167 R |
| 5,366,619 | A | 11/1994 | Matsui et al. | |
| 5,971,220 | A | 10/1999 | Payne | |
| 6,209,753 | B1 | 4/2001 | Ohu | |
| 6,644,512 | B2 | 11/2003 | Li et al. | |
| 6,691,902 | B2 * | 2/2004 | Gomez | 222/566 |
| 2002/0100767 | A1 | 8/2002 | Mellon | |

* cited by examiner

*Primary Examiner*—Timothy L Maust
(74) *Attorney, Agent, or Firm*—Seth H. Ostrow; Dreier LLP

(57) ABSTRACT

The present invention is a dispenser protector device and method. In a preferred embodiment, the present invention comprises a fastener that is associated with a dispenser spigot, or like device. A shield is formed, or otherwise connected, to the fastener such that when the fastener is mounted to a dispenser spigot, the shield prevents direct contact with the spigot of outside elements. While numerous, differing types of contacts are anticipated and protected against by the present invention, the most typical is that when water bottle openings come in contact with dispenser spigots, which generally occurs when water bottles are being refilled. The present invention protects against such direct contact, and other forms of bacterial transmission. It is anticipated that the present invention may be of varied configuration, size, and material construction.

11 Claims, 2 Drawing Sheets

DISPENSER PROTECTOR DEVICE

BACKGROUND OF THE INVENTION

The mention of certain references in this section is not an admission that such references are, or qualify to be, prior art with respect to the present invention.

1. Field of Invention

The present invention relates to dispenser technology devices and methods. More specifically, the present invention relates to a dispenser protector that protects a dispenser, or like device, from the transmission of bacteria and other undesirable elements.

2. Description of the Prior Art

Modernly, bottled drinking water is becoming more prevalent, particularly in homes and offices. Reports show that consumers can spend upwards of $300.00 per household over the course of a year in bottled water. This demand is largely driven by the desire to obtain drinking water that is safe and bacteria-free.

Over the past 20 years, demand for bottled water has generally been on the rise. Estimates show that in 2002, bottled water consumption tripled since 1991. Revenues for bottled water sales totaled approximately $7.6 billion in 2002, according to the Beverage Marketing Corporation. Driven by current trends towards healthier life styles, it appears the bottled water industry will continue to grow in the future.

Given the rise in cost of bottled water, which can be more expensive than other drinks such as sodas, consumers often refill their empty water bottles from accessible water dispensers, typically found in homes and offices. However, a number of reports indicate that reusing of water bottles may lead to the propagation of undesirable levels of bacteria in the reused bottle. Thus, while consumers are careful to select bottled water to ensure healthiness, the derived benefit is compromised by the potential introduction of undesirable bacteria to the reused bottle.

Bacteria may be found on food particles, saliva and sweat, all potentially present on the opening of reused bottles. Typically, when a water bottle is refilled, the water dispenser spigot is placed into the water bottle opening, thereby transmitting bacteria from the water bottle to the water dispenser spigot. Because other consumers will invariably use the water dispenser to drink or fill their water bottles, the bacteria from one water bottle may be transmitted to numerous other individuals resulting in an increased potential to promote undesirable bacterial proliferation. In an office environment, one employee may deposit bacteria on a water dispenser spigot, which can later be communicated to countless other employees who use the same water dispenser.

In an attempt to address the problems associated with bacterial proliferation in water supplies, a number of references exist that generally address bacterial contamination of dispensers. For example, in the reference to Matsui, et al., U.S. Pat. No. 5,366,619, a germ free drinking water dispenser is disclosed. This reference requires the incorporation of an ozone injecting device that acts to sterilize the reservoir area of a water dispenser thereby maintaining the sterilized quality of the drinking water found in the original water dispenser container. The Matsui reference involves complicated, and expensive, improvements to existing water dispensers. Also, this reference does not address the specific issue of bacteria transmitted to consumers from a dispenser spigot.

In another example, the reference to Mellon, U.S. Pat. App. No. 2002/0100767 A1, discloses a container for holding liquids that discourages the user from putting his or her mouth on the container to access the contents. While this reference may prevent or deter the transmission of bacteria by avoiding direct mouth contact in liquid containers, once again, it does not address the problems associated with transmitting bacteria through a water dispenser spigot. Furthermore, this reference involves a relatively complicated incorporation of drink guards which will negatively affect the cost of manufacture.

Accordingly, it is desirable to have a dispenser protector that addresses the problems associated with bacterial contamination emanating from dispenser spigots. Further, it is desirable to have a device that addresses the problems found in the prior art in an efficient and effective manner. However, and in view of the foregoing, nothing in the prior art addresses these problems.

SUMMARY OF THE INVENTION

The present invention is a dispenser protector device and method. The present invention combines a number of desirable features all housed in an efficient, portable, reusable, disposable and convenient device and method.

In one preferred embodiment, the present invention comprises a fastener which is designated to fit onto a dispenser spigot, or like device. An associated shield, of a size and configuration large enough to accommodate bottle openings, is formed at one end of the fastener. Thus, the fastener may be removably connected to a dispenser spigot, and a bottle opening is placed under the shield of the present invention allowing for the bottle to be filled without direct contact with the spigot of the dispenser, nor with the shield itself. The present invention will also protect the dispenser from other forms of contamination such as dust, pets or other animals seeking water, and airborne bacteria and the like. It is anticipated the present invention may be of varied configuration, size, shape, and material construction.

The present invention does not necessitate direct contact between the water bottle opening and the shield of the present invention. However, to the extent such contact occurs, the present invention may be sterilized, or in the alternative, disposed of and replaced on a regular basis. As such, an alternative embodiment of the present invention incorporates disposability of the present invention, so that after repeated uses, the present invention may be discarded and a new unit replaced in its stead, thereby assuring further bacterial protection.

In another alternative embodiment of the present invention, the present invention may be constructed of plastic, rubber, or other like materials. Such materials may also be of varying colors or translucent. In another preferred alternative embodiment of the present invention, the present invention may be attached to a connector assembly associated with a water dispenser, whereby the present invention is accessible even when not connected to the water dispenser spigot.

It is therefore an object of the present invention is to provide a new and improved multi-purpose dispenser protector that has all the advantages of the prior art, yet none of the disadvantages. It is a further object of the present invention to provide a new and improved dispenser protector that may be easily and efficiently manufactured and marketed. It is yet a further object of the present invention to provide a new and improved dispenser protector that is of durable and reliable construction.

Another further object of the present invention is to provide a new and improved dispenser protector that is of low cost to manufacture with regard to both materials and labor, and which, accordingly, is then susceptible of low prices of sale to the consuming public, thereby making the present invention economically available to the buying public.

Yet another object of the present invention is to provide a new and improved dispenser protector that is portable and can be used in a myriad of locations and situations.

The present invention may be better understood by referring to the following Detailed Description, which should be read in conjunction with the accompanying Drawings. The Detailed Description of a particular preferred embodiment, described below, is intended to be a particular example, and not a limitation.

BRIEF DESCRIPTION OF THE DRAWINGS

The accompanying Drawings, which are incorporated in and constitute a part of the specification, illustrate preferred embodiments of the present invention, and together with the preceding general description and the following Detailed Description, explain the principles of the present invention.

In the Drawings.

DETAILED DESCRIPTION OF THE INVENTION

Embodiments consistent with the present invention address the need for an efficient dispenser protector. While the prior art attempts to address this need, only the present invention provides a device and method that adequately addresses this need. The device and method described herein may be implemented in a variety of manners. Accordingly, the description of a particular embodiment herein is intended only for the purposes of example, and not as a limitation.

Figure 1:
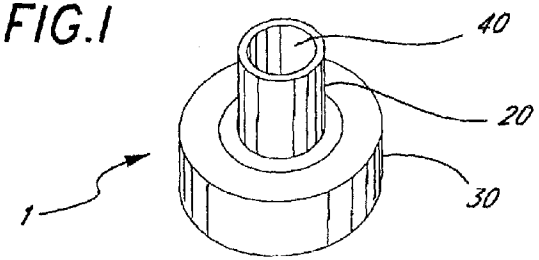
FIG. 1 is an illustration of a preferred embodiment of the present invention. It is anticipated the present invention can take a number of configurations, sizes and shapes, yet still provide the same benefit.

FIG. 1 illustrates a preferred embodiment of the present invention (1). A fastener (20) having an opening (40) of a first diameter and a distal portion allows the present invention (1) to be mounted to a dispenser spigot (not pictured). At the distal end of the fastener (20), a shield (30) with a second diameter, greater than the first diameter of the fastener opening, is positioned. Thus the present invention (1) protects the water dispenser spigot from entry of foreign objects and from direct contact from users of the water dispenser. The types of contact anticipated and protected against include, but are not limited to, user hands and fingers, dust, animals such as cats, dogs and other pets seeking water, insects and rodents, bottle openings coming in contact when being refilled, and from the introduction of airborne bacteria and the like.

While the embodiments in the Drawings illustrate a fastener and shield of generally cylindrical shape, the present invention (1) contemplates numerous configurations comprising different shapes, sizes and textures. Furthermore, the present invention (1) may be constructed of varying materials, including but not limited to hard plastics, malleable plastics, metals, rubber-like compounds, and other materials. Such materials may also be of varying colors or translucent. The present invention (1) may be constructed as one piece, or may be an assembly of multiple pieces.

Figure 2:
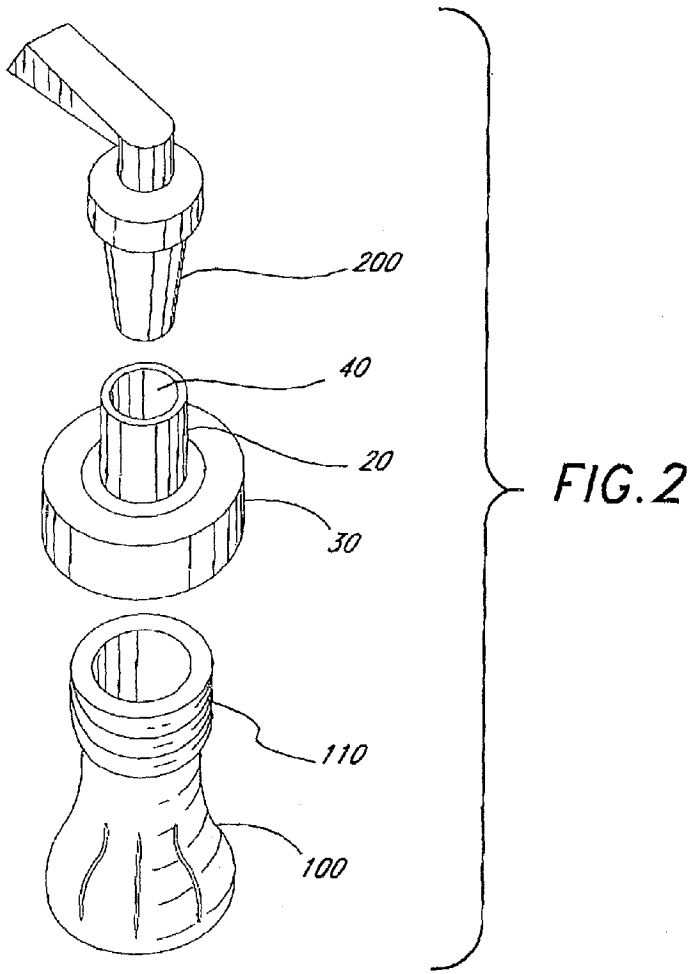
FIG. 2 is an illustration of a preferred embodiment of the present invention positioned between a dispenser spigot and a bottle opening.

As can be seen in FIG. 2, in a typical situation a user will bring an empty water bottle (100) to the water dispenser (not pictured) to refill it. The water bottle opening (110) is positioned to envelop the water dispenser spigot (200) so as to avoid spillage of water. The spigot is opened, and the water bottle is filled. Almost invariably, the water bottle opening (110) makes direct contact with the water dispenser spigot (200). It is contended that reused water bottle openings contain undesirable bacteria, typically found in food particles, saliva and sweat. Because the water bottle opening (110) and water dispenser spigot (200) would generally make direct contact, bacteria is transferred from the water bottle opening (110) to the spigot (200). As such, each subsequent user of the water dispenser is at risk at being exposed to this bacterial proliferation.

This is particularly troublesome when the water dispenser is used by a large number of individuals, such as in a large family or office environment. For example, where one employee uses the water dispenser to refill a water bottle (100), all subsequent users of the water dispenser are exposed to this bacterial proliferation. This is true where subsequent users use the water dispenser to obtain water in a cup or other container, or when they refill their empty water bottles. This problem is compounded where numerous water bottles are filled, each bottle thereby depositing greater numbers of bacteria. This problem is further compounded when a user is sick, and therefore, each subsequent user becomes exposed to the sick user's bacteria which can spread the sickness among other office workers and users who later use the dispenser.

Figure 3:
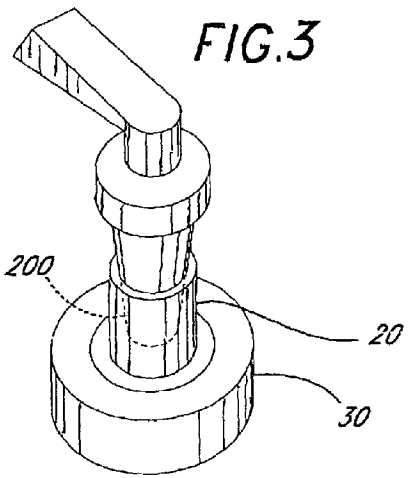
FIG. 3 is an illustration of a preferred embodiment of the present invention mounted to a dispenser spigot.

As shown more particularly in FIG. 3, the present invention eliminates direct contact of the bottle opening to the dispenser spigot. Once the fastener (20) is mounted to the dispenser spigot (200), the shield (30) acts as a barrier prohibiting the bottle opening (110) from contacting the spigot (200). Indeed, when used properly, the bottle opening (110) need never contact the shield (30) of the present invention (1). However, to the extent such contact occurs, and for the purposes of general cleanliness, the present invention may be removed and sterilized, or replaced altogether.

The fastener (20) may be secured to the spigot (200) in a number of possible manners. For example, the fastener (20) may be made of stretchable, rubber-like material such that when stretched onto the spigot (200), the fastener (20) grasps the spigot (200) by direct frictional contact. Other manners of mounting the fastener (20) to the spigot (200) include use of screw threads, ring clamps, tapered press fits and other forms of pressure fits.

Figure 4A:
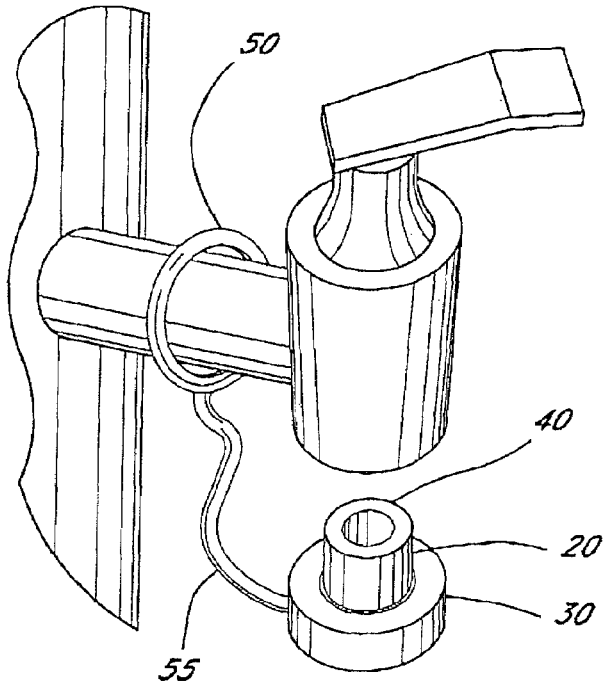
FIG. 4A is an illustration of a preferred embodiment of the present invention incorporating a connector assembly.

FIG. 4A illustrates the present invention (1) in conjunction with a connector assembly (50, 55). The connector assembly (50, 55) comprises a ring (50) that may be fit over a dispenser spigot (200), or otherwise mounted thereto. A leash (55) is connected to the ring (50) at one end. At the other end of the leash (55), the present invention (1) is connected. It is anticipated that the present invention (1) may be connected to the leash (55), at any place, including at the fastener (20), or at the shield (30).

As such, the present invention (1) may be removed from the spigot (200) while, at the same time, allowing the present invention (1) to be positioned near and accessible to the dispenser should later use be required. For example, those users who traditionally fill cups, glasses or other containers, may prefer to use the dispenser without the presence of the present invention (1). When the user brings an empty water bottle to be filled, that user may simply take the present invention (1) from its nearby position and connect it to the spigot (200). Thereafter, the present invention may be easily removed by either that user, or a subsequent user.

Figure 4B:
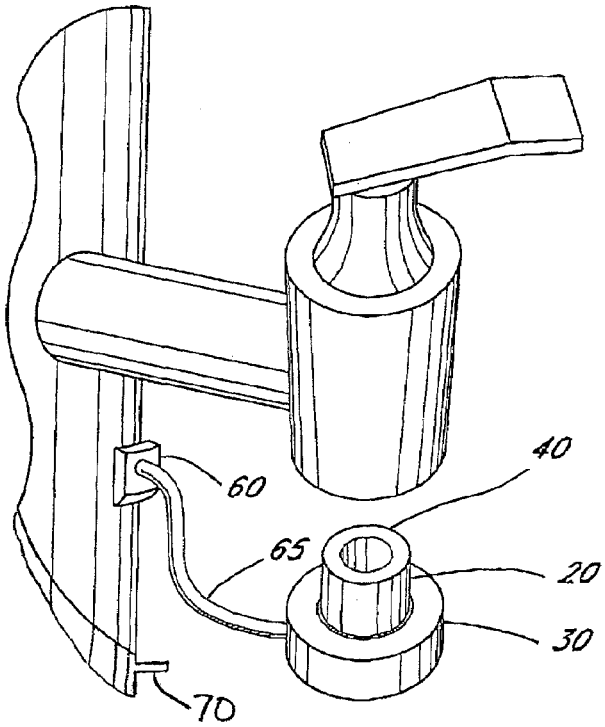
FIG. 4B is an illustration of a preferred embodiment of the present invention incorporating an alternative embodiment of the connector assembly.

FIG. 4B shows an alternative embodiment of the connecter assembly (60, 65) that comprises an anchor (60). Where it is impractical or undesirable to use the ring (50) disclosed in the previous connector assembly (50, 55), an anchor (60) may be connected on or near to the dispenser to facilitate the positioning of the present invention (1) near the dispenser spigot (200). The anchor (60) may be connected to the dispenser in a variety of manners including mechanically or by adhesives. The leash (65) runs from the anchor (60) to the present invention (1), in a similar fashion as disclosed above. In yet another embodiment of the connector assembly (not pictured), the dispenser protector may be removably housed in a seat (70), the seat being mounted to or otherwise associated with the dispenser.

What is claimed is:

1. A dispenser protector, comprising:

a substantially cylindrical fastener having a first end and a second end, the first end adapted to frictionally engage an outer surface of a spigot of a fluid dispenser and the second end having an opening, the opening being of a first diameter;

a substantially cylindrical shield coupled to the second end of the fastener and covering the opening, said shield being of a second diameter greater than the first diameter, the shield having a coupling means for being selectively coupled to a receiving receptacle;

a connector assembly having a first end coupled to an outer surface of the shield and a second end adapted to be coupled to the fluid dispenser, wherein a height of the fastener is selected so that, when the fastener is coupled to the spigot, a distal end of the spigot does not contact the receiving receptacle, and wherein the shield is adapted to frictionally engage a seat disposed on the fluid dispenser.

2. The dispenser protector in claim 1, wherein said fastener is constructed of flexible material.

3. The dispenser protector in claim 1, wherein said shield is constructed of flexible material.

4. The dispenser protector in claim 1, wherein said dispenser protector is constructed of flexible material.

5. The dispenser protector in claim 1, wherein said dispenser protector is constructed of material that may be repeatedly sanitized.

6. The dispenser protector in claim 1, wherein said shield is disposable.

7. The dispenser protector in claim 1, wherein said dispenser protector is disposable.

8. The dispenser protector in claim 1, wherein said dispenser protector is of varying colors.

9. The dispenser protector in claim 1, wherein said dispenser protector is translucent.

10. The dispenser protector in claim 1, wherein said connector assembly comprises a leash and the second end is a ring, said ring encircling a shaft connecting the spigot to the fluid dispenser.

11. The dispenser protector in claim 1, wherein said connector assembly comprises a leash and the second end is an anchor, said anchor connected to the fluid dispenser.

* * * * *